United States Patent [19]

Rogers

[11] Patent Number: 4,651,623

[45] Date of Patent: Mar. 24, 1987

[54] WORK CYLINDER HAVING A PISTON MEMBER WITH AN INTEGRAL CUSHIONING ARRANGEMENT

[75] Inventor: Larry K. Rogers, Lexington, Ky.

[73] Assignee: American Standard Inc., Lexington, Ky.

[21] Appl. No.: 679,321

[22] Filed: Dec. 7, 1984

[51] Int. Cl.[4] ..... F15B 15/22

[52] U.S. Cl. ..... 91/396; 92/85 B; 92/249

[58] Field of Search ..... 91/395, 396, 394, 26; 137/512.4; 92/249, 248, 85 B

[56] References Cited

U.S. PATENT DOCUMENTS

| | | | |
|---|---|---|---|
| 2,884,903 | 5/1959 | Pauly | 91/395 |
| 2,912,999 | 11/1959 | Kersh | 137/512.4 |
| 4,142,446 | 3/1979 | Ides | 91/395 |
| 4,171,665 | 10/1979 | Stoll | 91/395 |
| 4,210,064 | 7/1980 | Beerens | 92/85 B X |

FOREIGN PATENT DOCUMENTS

| | | | |
|---|---|---|---|
| 2163840 | 6/1973 | Fed. Rep. of Germany | 92/249 |
| 1133853 | 11/1956 | France | 91/26 |
| 644719 | 2/1961 | Italy | 92/249 |

*Primary Examiner*—Robert E. Garrett
*Assistant Examiner*—Mark A. Williamson
*Attorney, Agent, or Firm*—G. E. Hawranko

[57] ABSTRACT

A work cylinder having a piston of single-body construction and a cushioning arrangement integrally formed on the piston includes a cylinder housing having a chamber formed therein divided into first and second work chambers by the piston. First and second piston extensions extend into first and second graduated chamber portions formed at opposite ends of the cylinder housing. A sealing material, bonded to the exterior surface of the piston, exhibits a dual cup-shaped piston seal around the center portion and annular cushion seals on the piston extensions. The cushion seals are at an angle such that, when in contact with a first chamber reduction, a seal results. Additionally, in the opposite direction, the cushion seals act as a check valve whereby fluid pressure introduced to a second chamber reduction depresses the cushion seals and flows into the selected work chamber. When the piston is moving into the second chamber reduction portion, the annular cushion seals channel fluid present in the work chamber to the second chamber reduction portion thereby providing a variable cushioning fluid pressure.

10 Claims, 2 Drawing Figures

WORK CYLINDER HAVING A PISTON MEMBER WITH AN INTEGRAL CUSHIONING ARRANGEMENT

BACKGROUND OF THE INVENTION

This invention relates to a fluid-pressure-operated, double-acting work cylinder having a piston member constructed with an integral piston cushioning arrangement; more specifically, such integrally cushioned piston member being of a single-body construction. Typically, work cylinders have included multiple-component piston assemblies having a number of seals and seal-attaching means which, by requiring such a plurality of components, only serve to increase the cost of the device both at the manufacturing and maintenance levels.

Additionally, typical multiple-component piston assemblies have attempted to include a cushioning arrangement to the work piston which, by engaging a reduced-diameter chamber portion, have used a fixed amount of fluid to cause a pressure buildup acting in an opposing direction to movement of the work piston to effect a cushioning of the final piston movement. Such cushioning arrangements have had the disadvantage of requiring an additional number of components at a higher cost and, furthermore, have proven to be limited in effect, are not accurately controllable and adjustable with respect to the cushioning effect due to the trapping of the fixed amount of fluid. By cushioning with a fixed amount of trapped fluid, the sealing arrangements of the work pistons have also been unduly strained since, as the piston nears the final stopping point, the fluid pressure generated in an opposing direction to work piston movement, increases significantly thereby adversely affecting the work piston seals.

Furthermore, such piston cushioning arrangements have required an extended length of the cylinder chamber to effect cushioning and still provide a port opening such that, fluid pressure could be introduced to the chamber to move the work piston in the opposite direction. This comes about as a result of the need to have an amount of chamber space sufficient to compress the fixed amount of trapped fluid to achieve a fluid pressure level which can cushion work piston movement.

Still other work cylinder, piston assemblies have attempted to provide a single-body piston construction incorporating the seals as a part of the piston body, and further, including a type of piston cushioning thereon as well. An example of such a work cylinder piston assembly can be found in U.S. Pat. No. 2,984,529, wherein a single piston has a sealing material coating and a plurality of rubber buttons to cushion piston movement. This approach, however, has the disadvantage of cushioning mainly by contact of the buttons to a chamber portion, there being little provision for fluid pressure buildup to cushion piston movement, inasmuch as the space between the button allows escape of any fluid pressure around this cushioning arrangement.

SUMMARY OF THE INVENTION

The object of the invention, therefore, is to provide a work cylinder having a single-body piston member having sealing and cushioning features incorporated thereon.

It is a further object of the invention to provide such a work piston whereby the cushioning function is controllable to the degree that accurate adjustment of the cushioning function can be accomplished.

It is yet a further object of the invention to provide such a work cylinder having the cushioning function effected by one of a plurality of angularly disposed annular sealing lips which also serve as check valves between the work chambers and the pressurized chambers.

Still a further object of the invention is to provide a work cylinder whereby the cushioning function can be accomplished using a relatively short portion of the piston stroke thereby reducing the overall length of the cylinder housing.

An even further object of the invention is to provide a cushioning arrangement which results in a stable cushioning force acting on the work piston thereby resulting in less of a straining force exerted on the work piston seals.

Briefly, the invention consits of a cylinder housing having a chamber formed therein and two ends secured thereto, with one of the ends having an opening to allow extension of a piston rod therethrough. A single-body constructed work piston, on which the piston rod is attached, is reciprocally movable within the chamber under the influence of fluid pressure introduced to one of two work chambers which are disposed on opposite sides of the work piston.

The work piston is constructed having a rigid core portion with a piston wall formed intermediate two piston extension portions. The rigid core portion is covered on all exterior portions with a flexible sealing material, the piston wall having a dual cup-shaped seal covering. The piston extensions, which extend coaxially longitudinally from the piston wall, are covered with a sealing material which is essentially flat and has extending angularly therefrom, a series of annular cushion seals angled toward the piston wall. The cylinder ends have pressurizing chambers formed therein, which receive a portion of the piston extensions having the annular cushion seals. An annular chamber reduction, formed of a smaller diameter than the pressurizing chambers and formed in the cylinder ends adjacent the work chambers, serves to deflect the annular cushion seals as the piston extension is moving into the pressurizing chambers. Each of the annular cushion seals can, therefore, seal between the work chamber and pressurizing chamber and thus provide a varying amount of trapped fluid pressure to act as a piston cushioning force. An adjustable metering valve is formed in each cylinder end to allow adjustment of the cushioning function.

DESCRIPTION AND OPERATION

Figure 1:
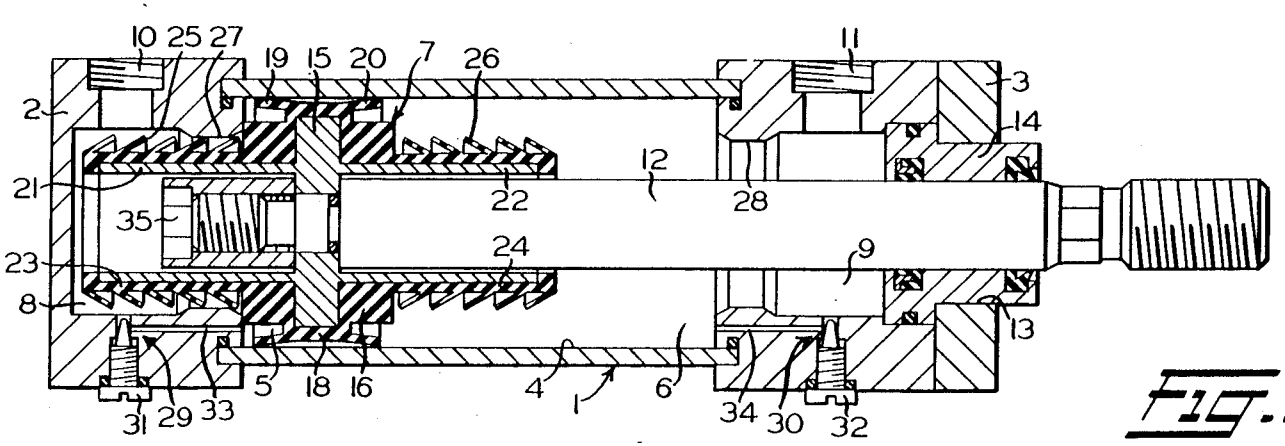
FIG. 1 is an elevational view, in section, of a work cylinder having a single-body work piston constructed in accordance with the invention.

As seen in FIG. 1, a fluid-pressure-operated, double-acting work cylinder having a single-body work piston with an integral cushioning arrangement includes a cylinder housing 1 sealed on both ends by first and second cylinder ends 2, 3. A cylinder chamber 4, formed within the cylinder housing 1, is divided into first and second work chambers 5, 6 by a work piston shown generally at 7 and which is reciprocally movable within the cylinder chamber 4.

Formed in respective first and second cylinder ends 2, 3 and in fluid communication with the first and second work chambers 5, 6 are first and second pressurizing chambers 8, 9 and first and second pressure openings 10, 11. Fluid pressure can be introduced through the first and second pressure openings 10, 11 to the respective work chambers 5, 6 from a fluid pressure source (not shown).

A piston rod 12 is secured to one side of the work piston 7 and extends from the work piston 7 through a rod opening 13 formed in the second cylinder end 3 such that, the controlled device (not shown) can be attached thereto. A rod sealing arrangement 14 is disposed around the piston rod 12 at the rod opening 13 such that, the chamber 4 is securely sealed and the piston rod 12 can be easily moved therethrough.

The work piston 7 is constructed essentially having a rigid center core portion 15 and a flexible sealing material 16 molded onto the exterior surface of the rigid center core portion 15. In this manner, it can be appreciated that the work piston 7 is of a single-body construction having sufficient material strength to be effective in applications requiring higher fluid pressure operating levels and yet can effectively seal between chambers without requiring a multitude of components.

The center core portion 15 is formed having a center piston wall 17 which radially extends substantially toward the wall of the chamber 4. Bonded onto the center piston wall 17 is a dual cup-shaped piston seal 18 which is in sealing contact with the wall portion of the chamber 4. The piston seal 18 is formed having first and second cup portions 19, 20 extending from piston seal 18 at an angle toward the wall of the chamber 4 and into each of the first and second work chambers 5, 6.

The first and second cup portions 19, 20 are of a flexible sealing material and are prestressed such that, they are urged toward the wall portion of the chamber 4 for a more positive sealing effect. In this manner, it can be appreciated that the first and second cup portions 19, 20 are pressure-energized; that is, the fluid pressure introduced to either the first or second work chamber 5, 6 acts to further urge the cup portions 19, 20 toward the wall portion of the chamber 4. The first and second cup portions 19, 20 can also be categorized as being wear-compensating in that, as the sealing material wears, the fluid pressure further urges the first and second cup portions 19, 20 against the wall portion of the chamber 4.

The center core portion 15 exhibits first and second piston extensions 21, 22 which extend longitudinally coaxially outward from the center piston wall 17 into the respective first and second work chambers 5, 6. The first and second piston extensions 21, 22 can be of an essentially hollow construction so that the piston rod 12 can extend within one of the piston extensions 21 or 22 and be secured to the center piston wall 17.

The first and second piston extensions 21, 22 have bonded thereon first and second thin seal layers 23, 24 of the similar flexible sealing material as is bonded to the center piston wall 17. In fact, the flexible sealing material bonded to the center core portion 15 is preferably of the same material and is bonded to all of the portions of the center core portion 15 simultaneously, thereby minimizing manufacturing costs and providing continuity of sealing material over the entire exterior surface of the center core portion 15.

Figure 2:
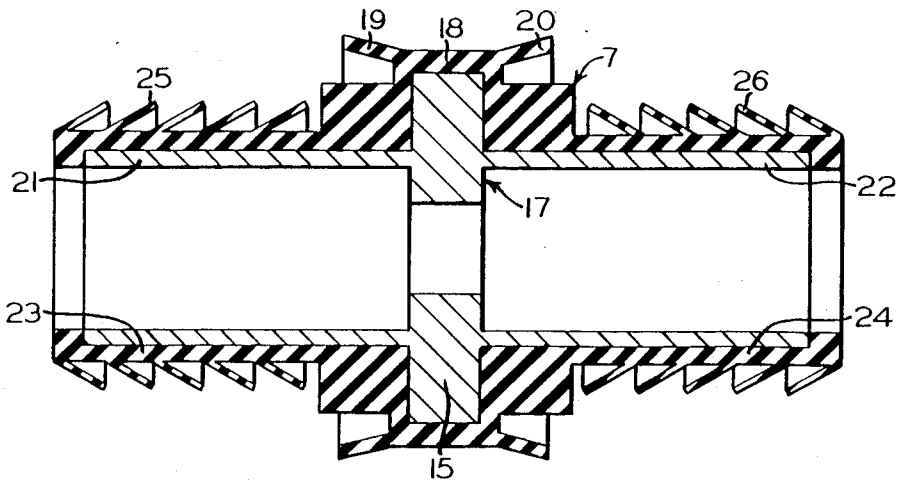
FIG. 2 is an elevational view, in section, of a single-body work piston having integral cushioning means and constructed in accordance with the invention.

As seen in FIGS. 1 and 2, the seal layers 23 and 24, bonded to the first and second piston extensions 21, 22, have projecting therefrom, first and second pluralities of angularly disposed annular cushion seals 25, 26 sequentially arranged and angled such that, the cushion seals 25, 26 flare out from the seal layers 23, 24 of the first and second piston extensions 21, 22 in a direction toward the center core portion 15 of the work piston 7. As is the situation of the cup portions 19, 20 of the piston seal 18, the first and second pluralities of cushion seals 25, 26 are pressure-energized and wear-compensating, therefore exhibiting lesser adverse friction effects. Additionally, because of a reduced sealing contact of each of the individual annular sealing rings which make up the first and second pluralities of cushion seals 25, 26 against a portion of the chamber 4, as will be described hereinafter in further detail, the first and second pluralities of cushion seals 25, 26 experience less wear per seal with the wear being distributed over several of the individual sealing rings of the plurality of cushion seals instead of just one.

Formed in the first and second cylinder ends 2, 3, between the first work chamber 5 and first pressurizing chamber 8, and between the second work chamber 6 and second pressurizing chamber 9, are respective first and second annular chamber reductions 27, 28 which, by being formed having smaller diameters than the first and second work chambers 5, 6, can be considered as graduated chambers.

As seen in FIG. 1, the first and second annular chamber reductions 27, 28 provide a reduced opening between the respective work and pressurizing chambers such that, as the work piston 7 is moved toward one of the two cylinder ends 2, 3, one of the first and second pluralities of cushion seals 25, 26 comes into sealing contact with the annular chamber reduction 27 or 28 to seal between the work chamber 5 or 6 and pressurizing chamber 8 or 9. It will be observed that each of the first and second chamber reductions 27, 28 are chamfered on the leading and trailing edges to allow for smooth movement of the first and second pluralities of cushion seals 25, 26 thereover in either direction of movement of the work piston 7.

The relation between the first and second chamber reductions 27, 28 and the angled disposition of the first and second pluralities of cushion seals 25, 26 is such that, the pluralities of cushion seals 25, 26 are urged toward the first or second seal layers 23 or 24 upon contacting the first or second annular chamber reductions 27, 28 thereby slightly reducing the angle of the cushion seals, yet still maintaining a sealing contact to prevent fluid pressure communication between pressurizing chamber 9 or 10 and work chamber 5 or 6 as the work piston 7 is moving into the pressurizing chamber 9 or 10. The angle of the first and second plurality of cushion seals 25, 26 can also be deflected further during pressurization of either the first or second pressurizing chamber that the work piston 7 is moved into. When such pressurization occurs, the first and second pluralities of cushion seals 25, 26 act as open check valves; that is, fluid pressure deflects the cushion seals and thereafter flows around the piston extension 21 or 22 into the work chamber 5 or 6 to move the work piston 7 in an opposing direction.

Again referring to FIG. 1, it can be appreciated that at times it is desirable to have an adjustment provision which allows circumventing the strict sealing arrangement between the work chamber 5, 6 and pressurizing chamber 8, 9 affected by the first or second plurality of cushion seals 25, 26. To this end, first and second adjustable metering valves 29, 30 are provided in respective first and second cylinder ends 2, 3 connecting between the pressurizing chamber 8, 9 and work chamber 5, 6. A metering screw 31, 32 is provided with each of the first or second metering valves 29, 30, to vary the amount of fluid pressure that can flow therethrough.

In operation, it will be assumed that it is desired to have the work piston 7 in the retracted position as shown in FIG. 1. To achieve this position, a fluid pressure is first introduced to the second work chamber 6 from a fluid pressure source (not shown) through the second pressure opening 11 and second pressurizing chamber 9. Upon the leading end of the work piston 7; namely, the first piston extension 21, first seal layer 23, and first plurality of cushion seals 25, contacting the leading chamfered end of the first annular chamber reduction 27, fluid pressure begins to build up in the nonpressurized first work chamber 5 to act on the work piston 7 in a direction opposite retracting movement of the work piston 7.

This buildup of fluid pressure occurring in the nonpressurized first work chamber 5, or cushion area, results from whatever fixed amount of fluid, present in the first work chamber 5, is being compressed as the volume of the first work chamber 5 is being decreased upon movement of the work piston 7 therethrough. Following continued movement of the work piston 7, the first of the plurality of cushion seals 25 passes by the first annular chamber reduction 27 and enters the first pressurizing chamber 8 whereupon the first cushion seal 25 unflexes to the original angled, nonsealing condition and effectively channels a portion of the fixed amount of fluid originally trapped in the cushion area, to the first pressurizing chamber 8. The length of the first annular chamber reduction 27 is designated such that, at least the second layer annular cushion seal engages the first annular chamber reduction 27 before the first layer annular cushion seal moves freely into the first pressurizing chamber 8, such feature effectively preventing backflow of fluid pressure from the first pressurizing chamber 8 to the first work chamber 5. Once in the first pressurizing chamber 8, this channelled fluid can be exhausted to atmosphere or any other similar volume of reduced fluid pressure. This same channeling effect occurs for each passage of the cushion seal past the annular chamber reduction 27 such that, the volume of fluid trapped in the cushion area is varied downward thus achieving a fluid-reducing effect in the cushion area. It can be appreciated that by reducing this amount of fluid present in the nonpressurized work chamber 5 as the volume of that work chamber 5 is being reduced by movement of the work piston 7 therethrough, an ever-increasing opposing force to the work piston 7 movement is avoided. The resulting beneficial reduction of straining forces acting on all seal portions can be realized therefrom. As a further advantage of such trapped cushioning fluid being varied and of the plurality of cushion seals 25 acting in a sequential effective manner, the overall length of the work cylinder and the cylinder portion in which the cushioning is being effected, can be reduced since the pressure opening and/or cylinder head crossbores can be moved closer to the work chamber.

By adjusting the metering screw 31 of the first metering valve 29, the speed or effectiveness of the cushioning action can be controlled.

In the reverse action, that is, extension of the work piston 7 through the work cylinder, fluid pressure is first introduced to the first work chamber 5 through the first pressure opening 10 and first pressurizing chamber 8. In pressurizing the first pressure chamber 5, the first plurality of cushion seals 25 act as individual check valves which allow the passage of fluid pressure to the work piston 7 such that, the work piston 7 can be urged away from the first cylinder end 2 in a desired quick motion. Upon movement of the work piston 7 through the chamber 4, the second piston extension 22 will eventually approach the second annular chamber reduction 28 such that, the second plurality of cushion seals 26 act in the same cushioning, channelling manner as previously described relative to retracting movement of the work piston 7.

Although the hereinabove forms of the invention constitute preferred embodiments, it can be appreciated that modifications can be made thereto without departing from the scope of the invention as detailed in the appended claims.

An as example of such a modification, the cushion seal design shown can be modified such that, the cushion seal is positive in both directions; that is, the built-in check valve feature is not provided, thus facilitating manufacturing operations.

Another example of such a modification would be to remove the first and second piston extensions 21, 22 and support the first and second seal layers 23, 24 and first and second pluralities of cushion seals 25, 26 by a piston rod arrangement similar to that shown in FIG. 1 but of a larger diameter than the first and second piston extensions 21, 22.

Yet another example of a modification would be to construct the cylinder housing 1 without the first and second annular chamber reductions 27, 28. In this example, the first and second pluralities of annular cushion seals 25, 26 could perform the cushioning function merely by communicating the fluid from one of the work chamber 5, 6 to the respective pressurizing chamber 8 or 9 which is at the lower fluid pressure valve.

Having now described the invention, what I claim as new and desire to secure by Letters Patent, is:

1. A fluid-pressure-operated work cylinder for operating a controlled device to one of a number of positions, said work cylinder comprising:

(a) a cylinder housing having a chamber formed therein;

(b) a work piston, reciprocally movable within said chamber, divides said chamber into a first and a second work chamber;

(c) an actuating member connected to said work piston for coincident movement therewith, said actuating member extending through said cylinder housing such that the controlled device can be secured thereto;

(d) a piston seal disposed on said work piston in sealing contact with said chamber;

(e) at least one piston support extending coaxially, longitudinally outward from said work piston into at least one of said first and second work chambers;

(f) at least one graduated chamber portion having a chamfered opening and formed in said cylinder housing adjacent at least one of said first and second work chambers;

(g) cushion sealing means disposed around at least a portion of said at least one piston support for engaging said at least one graduated chamber portion and cushioning said work piston during movement toward said at least one graduated chamber portion, said cushion sealing means having a plurality of cushion seals sequentially spaced along said at least one piston support such that, when said cushion sealing means engages said chamfered opening of said at least one graduated chambered portion, a variable cushioning fluid pressure is exerted on said work piston in opposition to such work piston movement; and (h) said plurality of cushion seals being disposed in a spaced-apart relation and at an angle directed toward said work piston such that, upon entering a first portion of said at least one graduated chamber portion, at least two of said plurality of cushion seals are first deflected downward and then reflected outward upon exiting said first portion of said at least one graduated chamber portion such that fluid pressure from said at least one work chamber can be channeled to a second portion of said at least on graduated chamber portion thereby, said plurality of angularly disposed cushion seals further acting as individual check valves such that, fluid pressure introduced to said at least one graduated chamber portion can flow around the circumferences of said plurality of cushion seals and said at least one piston support into at least one of said first and second work chambers.

2. A work cylinder, as set forth in claim 1, further including a cushion adjusting means formed in said housing between at least one of said first and second work chambers and said at least one graduated chamber portion for adjustably reducing the buildup of such variable cushioning fluid pressure acting on said work piston as said work piston moves into said graduated chamber portion.

3. A work cylinder, as set forth in claim 2, wherein said cushion adjusting means includes a metering valve having a valve passage and a metering screw adjustable such that, the volume of fluid flowing through said valve passage can be adjusted thereby.

4. A work cylinder, as set forth in claim 1, wherein said piston seal is cup-shaped having a flap portion extending into one of said first and second work chambers, said cup-shaped piston seal being pressure-energized such that, fluid pressure introduced to at least one of said first and second work chambers urges said cup-shaped piston seal against said chamber.

5. A work cylinder, as set forth in claim 1, wherein said at least one piston support is at least one piston extension integrally formed with said work piston and having a center core portion and further, wherein said piston seal and said cushion sealing means are of a similar sealing material and are bonded onto said center core portion such that, said work piston and said at least one piston extension are formed having a single-body construction.

6. A work cylinder, as set forth in claim 5, wherein said at least one piston extension is a first and a second piston extension, each formed on one side of said work piston in symmetrical relation to one another.

7. A work cylinder, as set forth in claim 6, wherein said at least one graduated chamber portion is a first and a second graduated chamber portion formed on opposite ends of said cylinder housing adjacent respective first and second work chambers, said first and second piston extensions being movable there within, said first and second graduated chamber portions each having first reduced chamber portions of smaller diameter than said first and second work chambers, and each further having second reduced chamber portions formed between respective said first and second work chambers and said first reduced chamber portions, said second reduced chamber portions being of smaller diameter than said first reduced chamber portions such that, when said cushion sealing means passes from said second reduced chamber portion to said first reduced chamber portion, such variable cushioning fluid pressure is exerted on said work piston.

8. A work cylinder, as set forth in claim 7, wherein said first reduced chamber portion of said first and second graduated chamber portions is a pressurizing chamber having a pressure opening through which such fluid pressure can be introduced to said chamber.

9. A work cylinder, as set forth in claim 1, wherein said actuating member is a piston rod connected to said work piston and extending through a rod opening formed in said cylinder housing.

10. A work cylinder, as set forth in claim 9, wherein said at least one piston support is formed by at least a portion of said piston rod.

* * * * *

UNITED STATES PATENT AND TRADEMARK OFFICE

CERTIFICATE OF CORRECTION

PATENT NO. : 4,651,623

DATED : March 24, 1987

INVENTOR(S) : Larry K. Rogers

It is certified that error appears in the above-identified patent and that said Letters Patent are hereby corrected as shown below:

Column 7, Claim 1 (h), line 21, delete "on" and insert --one--

Signed and Sealed this

Eighth Day of September, 1987

*Attest:*

DONALD J. QUIGG

*Attesting Officer*

*Commissioner of Patents and Trademarks*